US005897247A

United States Patent [19]

Tombs et al.

[11] Patent Number: 5,897,247

[45] Date of Patent: Apr. 27, 1999

[54] METHOD AND APPARATUS FOR APPLYING A CHARGE TO A MEMBER SO THAT A NET CHARGE FLOWING THROUGH A SEMICONDUCTIVE LAYER OF A CHARGE APPLYING MEMBER IS ABOUT ZERO

[75] Inventors: Thomas N. Tombs, Brockport; Diane M. Herrick, Rochester; William B. Vreeland, Webster, all of N.Y.

[73] Assignee: Eastman Kodak Comapny, Rochester, N.Y.

[21] Appl. No.: 09/103,272

[22] Filed: Jun. 23, 1998

[51] Int. Cl.[6] ..... G03G 15/16; G03G 15/02

[52] U.S. Cl. ..... 399/308; 399/168

[58] Field of Search ..... 399/168, 174, 399/176, 297, 302, 308, 313; 361/212, 221, 225

[56] References Cited

U.S. PATENT DOCUMENTS 4,062,812 12/1977 Safford et al. .
4,531,825 7/1985 Miwa et al. ..... 399/308
5,420,677 5/1995 Gross et al. .
5,724,636 3/1998 Tombs et al. .
5,732,314 3/1998 Tsukida et al. ..... 399/302

FOREIGN PATENT DOCUMENTS

98/04961 2/1998 WIPO .

*Primary Examiner*—S. Lee
*Attorney, Agent, or Firm*—Norman Rushefsky

[57] ABSTRACT

An apparatus and method for applying a charge features a moving charge applying member having an electrically conductive structure and a semiconductive layer supported upon the conductive structure. The semiconductive layer is formed of a material having a volume resistivity of between about $1\times10^{7}$ ohm-cm and about $1\times10^{11}$ ohm-cm. An electrical bias device electrically biases the charge applying member. The electrical bias device applies an electrical bias to the charge applying member so that an electrical current flows from a peripheral surface of the charge applying member through the semiconductive layer to the conductive structure and from the conductive structure through the semiconductive layer to the member to be charged so that a net charge flowing through the semiconductive layer is about zero. The charge flow in the different directions may be simultaneous or at different times.

22 Claims, 3 Drawing Sheets

METHOD AND APPARATUS FOR APPLYING A CHARGE TO A MEMBER SO THAT A NET CHARGE FLOWING THROUGH A SEMICONDUCTIVE LAYER OF A CHARGE APPLYING MEMBER IS ABOUT ZERO

FIELD OF THE INVENTION

The present invention relates to electrostatography, including electrography and electrophotography and more particularly, to apparatus and methods for applying charge using a member such as a roller having a semiconductive blanket layer. The member may be used as a transfer member for electrostatically transferring toner or a charging device for electrostatically charging another member.

DISCUSSION RELATIVE TO THE PRIOR ART

Generally, the process of electrophotographic recording is executed by imagewise exposing light onto a substantially uniformly charged photoreceptive member. The charged photoreceptive member when imagewise exposed by light selectively discharges a photoconductive layer thereon, thereby creating an electrostatic latent image of an original document on the photoreceptive member. This latent image is subsequently developed into a visible image by depositing charged marking particles onto the photoreceptive member such that the marking particles are selectively attracted to either the charged image areas or discharged image areas on the photoreceptive member. The marking particles on the photoreceptive member are then transferred from the photoreceptive member to a copy sheet or other support substrate to create an image which may be permanently affixed to the copy sheet providing a reproduction of the original document. In a final step, the photoreceptive member is cleaned to remove any residual marking particles thereon in preparation for successive imaging cycles. The original document may be in hard copy or electronic form.

Analogous processes also exist in other electrostatographic printing Applications such as, for example, ionographic printing and reproduction, where charge is deposited on a charge retentive surface in response to electronically generated or stored images.

The process of transferring marking particles from the photoreceptive member to the copy sheet is realized at a transfer station. In a conventional transfer station, transfer is commonly achieved by applying electrostatic force fields in a transfer nip sufficient to overcome forces which hold the toner particles to its original support surface on the photoreceptive member. These electrostatic force fields operate to attract and transfer the toner particles onto the copy sheet either directly or indirectly through use of an intermediate transfer member (ITM).

In providing transfer using electrostatic force fields, it has been shown to be advantageous to use a transfer roller having a semiconductive layer that is electrically biased to provide transfer current. The functional life of the transfer roller is directly related to the volume resistivity of the roller within a predetermined range.

It is well known that charge control additives are added to materials forming the transfer roller to attain the desired resistivity levels for these rollers. However, as transfer current flows through the biased transfer member, the charge control additives in the base material migrate, depleting ions and increasing the resistivity of the material. As the resistivity increases, the bias voltage must be increased to maintain the appropriate transfer field. The corresponding increase in a pre-nip transfer field can create pre-nip ionization which can create severe copy quality problems.

Various solutions have been proposed for extending the electrical life of the transfer rollers.

In U.S. Pat. No. 4,062,812 there is proposed the use of certain salts having a particular geometric makeup which are useful for extending the functional electrical life and electrical stability of materials.

In U.S. Pat. No. 5,420,677 there is proposed the addition of an electrically-biased member that engages the biased transfer roller for reversing current flow through the transfer roller. The electrically biased member operates while bias is applied to the transfer roller during transfer to provide the reverse current flow to replenish ions depleted during the transfer process.

A problem associated with the solution set forth in U.S. Pat. No. 5,420,677 is that in the context of a charging roller such as a direct transfer apparatus or a primary charger, an extra power supply is required. It would thus be desirable to provide a solution to this long-standing problem that is more economical. It would also be desirable to provide a solution that is suitable in the context of an electrostatographic reproduction apparatus and method that uses an intermediate transfer process for transferring a toner image to a receiver sheet.

SUMMARY OF THE INVENTION

In accordance with a first aspect of the invention, there is provided an apparatus for applying a charge, the apparatus comprising a moving charge applying member, the charge applying member including an electrically conductive member and a semiconductive layer supported upon the conductive member, the semiconductive layer formed of a material having a volume resistivity of between about $1\times10^{7}$ ohm-cm and about $1\times10^{11}$ ohm-cm; and electrical bias means for electrically biasing the charge applying member, the electrical bias means applying an electrical bias to the charge applying member so that an electrical current flows from a peripheral surface of the charge applying member through the semiconductive layer to the conductive member and from the conductive member through the semiconductive layer to the member to be charged so that a net charge flowing through the semiconductive layer is about zero.

In accordance with a second aspect of the invention, there is provided a method for applying a charge, the method comprising moving a charge applying member into engagement with a member to be charged, the charge applying member including an electrically conductive member and a semiconductive layer supported upon the conductive member, the semiconductive layer being formed of a material having a bulk resistivity of between about $1\times10^{7}$ ohm-cm and about $1\times10^{11}$ ohm-cm; and electrically biasing the charge applying member so that an electrical current flows from a peripheral surface of the charge applying member through the semiconductive layer to the conductive member and from the conductive member through the semiconductive layer to the member to be charged so that a net charge flowing through the semiconductive layer is about zero.

BRIEF DESCRIPTION OF THE DRAWINGS

The invention will now be further described purely by way of example, with reference to the accompanying drawings, wherein.

DETAILED DESCRIPTION OF THE PREFERRED EMBODIMENTS

Because electrostatographic reproduction apparatus are well known, the present description will be directed in particular to elements forming part of or cooperating more directly with the present invention. Apparatus not specifically shown or described herein are selectable from those known in the prior art.

Figure 1:
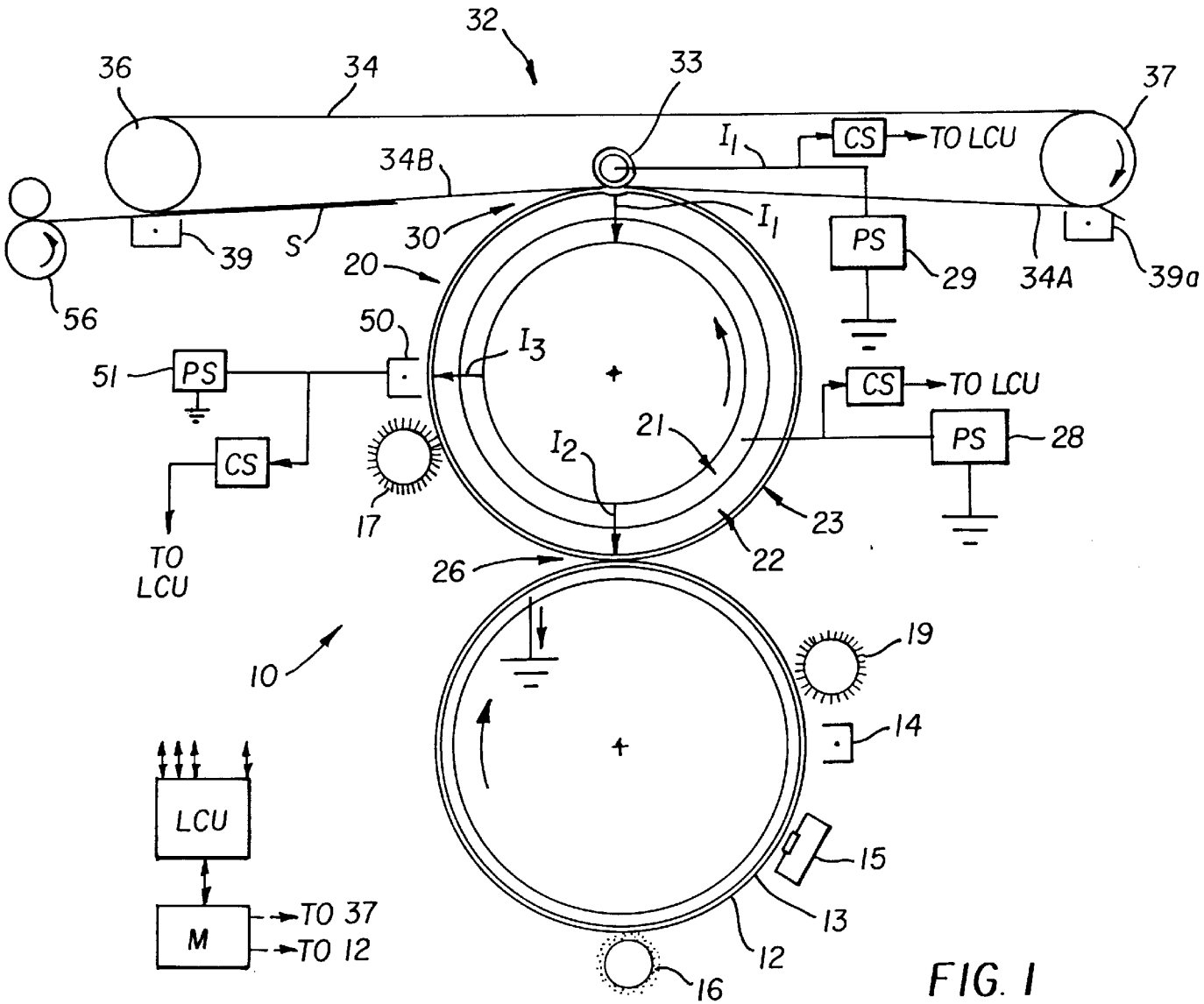
FIG. 1 is a side elevation view in schematic of a reproduction apparatus in accordance with the invention, the apparatus featuring indirect transfer and including an ITM.

Referring now to the accompanying drawings, FIG. 1 shows an exemplary image forming electrophotographic reproduction apparatus designated generally by the numeral 10. The reproduction apparatus 10 includes a primary image-forming member, for example a cylindrical drum 12 moving such as through rotation by a suitable drive such as provided by a motor M or driven through frictional engagement with another driven member that is moving (rotated) such as an ITM 20 to be described. The intermediate transfer member (ITM) 20 used in the embodiment of FIG. 1 is described in more detail by Tombs et al, U.S. Pat. No. 5,737,677, and more preferably in U.S. application Ser. No. 08/846,056, filed in the name of Vreeland et al, the contents of both of these references being incorporated by reference. The ITM is preferably in the form of a roller, i.e., substantially cylindrical. The drum 12 has a support 11 upon which is formed a photoconductive layer 13, upon which a pigmented marking particle image is formed. The drum 12 also features an electrically grounded layer or stripe. The marking particles are preferably of dry insulative toner particles. In order to form images, the outer surface of drum 12 is uniformly electrostatically charged by a primary charger(s) such as a corona charging device 14 or other suitable charger such as a roller charger, brush charger, etc. The uniformly charged surface is exposed by suitable exposure means, such as, for example, a laser or LED or other electro-optical exposure device 15 or even an optical exposure device to selectively alter the charge on the surface of the drum 12 to create a latent electrostatic image corresponding to an image to be reproduced. The electrostatic image is developed by application of pigmented marking particles to the image-bearing photoconductive drum 12 by a development or toning station 16. The developed marking particle image is transferred at nip 26 to the outer surface of a secondary or intermediate transfer member that is also rotating, for example, an intermediate transfer drum 20.

The intermediate transfer drum 20 includes a metallic electrically conductive core or member 21 such as aluminum (which may be a conductive layer) and a compliant polymer blanket layer 22. The compliant layer 22 is formed of an elastomer such as polyurethane or other materials noted in the applicable literature which has been doped with sufficient conductive material (such as antistatic particles, ionic conducting materials, or electrically conducting dopants) to have a relatively low resistivity and referred to herein as semiconductive. Further, the compliant layer is more than 1 mm thick, preferably between 2 mm and 15 mm, and has a Young's Modulus in the range of about 0.1 MPa to about 10 MPa, and more preferably between 1 MPa and 5 MPa. The volume electrical resistivity of the compliant layer is preferably between about $1\times10^{7}$ and about $1\times10^{11}$ ohm-cm. It is preferred to have a relatively thin hard outer skin or overcoat layer 23 having a thickness of 2–30 micrometers or less and the electrical resistivity of which may be higher than that of the compliant layer, in this regard reference may be made to U.S. application Ser. No. 08/846,056 regarding a preferred overcoat layer. The Young's Modulus of the overcoat layer is preferably greater than 100 MPa. With such a relatively conductive intermediate transfer member drum 20, transfer of the pigmented marking particle images to the surface of drum 20 can be accomplished with a relatively narrow (in length) nip 26 and a relatively modest voltage potential of, for example, $V_1$=600 volts applied by potential source 28 to ITM drum 20 and applied at the conductive core 21. The voltage potential establishes an electrical field between the ITM and the photoconductive drum which includes a ground layer or stripe to electrostatically urge toner particles to transfer from the photoconductive drum 12 to the surface of the ITM drum 20. After transfer of the marking particle image to the ITM the photoconductive surface 13 is cleaned by a cleaning device such as cleaning brush 19 or a blade of any untransferred marking particles and the surface is again electrostatically charged by charger 14 to a uniform primary charge suited for forming the next marking particle image.

The marking particle image formed on the surface of the intermediate transfer member drum 20 is transferred to a receiver member S, which is fed into and then out from a nip 30 between rotating intermediate transfer member drum 20 and a paper transfer roller 33. The receiver member S is a sheet of paper, cardboard or plastic or a composite material and is fed from a suitable receiver member supply (not shown) into nip 30 where it receives the marking particle image. The receiver member exits the nip 30 and is transported by a transport mechanism (not shown) to a fuser 56 where the marking particle image is fixed to the receiver member by application of heat and/or pressure. Preferably, the transport mechanism will support the receiver member for entrance into the fuser so that receiver member is free of engagement with an endless web 34 support which will be described in more detail below. The endless web 34 and the transfer backing roller 33 form a part of a transfer backing member 32. The receiver member with the fixed marking particle image is then transported to a remote location for operator retrieval. After transfer of the marking particle image to the receiver member S, a cleaning brush or other cleaning device 17 operates to clean the outer surface of the ITM of toner particles and other particles that can be removed from the surface to prepare the surface for receipt of the next toner image.

In the embodiments described herein, a photoconductive or primary imaging member may be a roller or a web. The primary imaging member need not be photoconductive and may record and develop images using electrographic recording processes. An ITM may also be a roller or a web.

Appropriate sensors (not shown) of any well known type, such as mechanical, electrical, or optical sensors for example, are utilized in the reproduction apparatus 10 to provide control signals for the apparatus. Such sensors may be located along the receiver member travel path between the receiver member supply through the nip 30 to the fuser 56. Further sensors are associated with the primary image-forming member photoconductive drum 12, the intermediate transfer member drum 20, the transfer backing roller 33, and various image processing stations. As such, the sensors detect the location of a receiver member in its travel path, and the position of the primary image-forming member photoconductive drum 12 in relation to the image-forming processing stations, and respectively produce appropriate signals indicative thereof. Such signals are fed as input information to a logic and control unit (LCU) including a microprocessor, for example. Based on such signals and a suitable program for the microprocessor, the LCU produces signals to control the timing operation of the various electrographic process stations for carrying out the reproduction process. The production of a program for a number of commercially available microprocessors, which are suitable for use with the invention, is a conventional skill well understood in the art. The particular details of any such program would, of course, depend on the architecture of the designated microprocessor.

As noted above, particular difficulties with the use of the intermediate transfer member are related to controlling the transfer field in the nip area between the intermediate member and the transfer backing member and in achieving reliable detack of a receiver member from the intermediate image transfer member. Further contributing to the difficulties is the fact that the receiver members utilized with the reproduction apparatus 10 can vary substantially. For example, they can be thin or thick paper stock or transparency stock. As the thickness and/or resistivity of the receiver member stock varies, the resulting change in impedance affects the electric field used in the nip 30 to urge transfer of the marking particles. Moreover, variations in relative humidity will vary the conductivity of a paper receiver member, which also causes it to affect the transfer field. Therefore, to overcome these problems, the transfer backing member 32 is an endless web arrangement. Reference to an endless web arrangement may be found in WO 98/04961 which corresponds to U.S. application Ser. No. 08/900,696. The invention as described for the embodiment of FIG. 1 may also be used in an embodiment where plural ITMs and photoconductors are used with each used to transfer a single color as described in aforementioned WO 98/04961 and U.S. application Ser. No. 08/900,696, the contents of which are incorporated by reference.

An insulating endless web (IEW) 34 wraps the ITM 20 to provide a nip for the transfer of toner from the ITM to receiver member or receiver sheet (e.g., paper, transparency, etc. preferably in sheet form) which moves between the web and ITM. The electric field that urges toner from the ITM to the receiver member is supplied to the backside of the IEW by a transfer backing roller 33 positioned to define with the ITM the transfer nip. Pressure is applied in the transfer nip by the transfer backing roller 33 so that the compliant ITM conforms to the surface irregularities of the receiver member and the toner image content on the ITM. The pressure reduces air gaps near the toner and therefore allows for higher electric fields and improved toner transfer efficiency. The transfer backing roller 33 may be replaced by a corona charger or electrically biased brush or blade. The receiver member S is removed from contact with the IEW 34 or detacks from the web 34 downstream from the transfer area opposite an IEW support roller 36. Discussed in detail below, various chargers may also be employed at other locations on the web to affect paper handling, web conditioning and paper detack. In each case a fuser is located downstream of the last transfer station (if multiple ITMs are used) or the transfer station (if a single ITM is used) to fuse the toner image to the receiver member.

The endless web arrangement of the transfer backing member 32 includes the endless web 34 entrained for movement as shown by the arrows about a plurality of support members. For example, as shown in FIG. 1, the plurality of support members are rollers 36 and 37 (of course, other support members such as skis or bars would be suitable for use with this invention). The endless web 34 is preferably comprised of a material having a volume electrical resistivity greater than $10^5$ ohm-cm and where electrostatic hold down of the receiver member is not employed, it is more preferred to have a volume electrical resistivity of between $10^8$ ohm-cm and $10^{11}$ ohm-cm. Where electrostatic hold down of the receiver member is employed, it is more preferred to have the endless web have a volume electrical resistivity of greater than about $1\times10^{12}$ ohm-cm. An endless web with the latter resistivity is considered herein an insulating endless web (IEW). The web material may be of any of a variety of flexible materials such as a fluorinated copolymer (for example, polyvinylidene fluoride), polycarbonate, polyurethane, polyethylene terephthalate, polyimides such as Kapton™, silicone rubber or polyethylene napthoate.

This volume resistivity of the IEW is the resistivity of at least one layer of the IEW if the IEW is a multilayer article. Preferably, the top layer of the IEW which is in contact with the receiver member is the layer with the volume resistivity of greater than about $1\times10^{12}$ ohm-cm. Whichever material that is used, such web material may contain an additive, such as an anti-static (e.g., metal salts) or small conductive particles (e.g., carbon), to impart the desired resistivity for the web. When materials with high resistivity are used (i.e., greater than about $10^{11}$ ohm-cm), additional corona charger (s) may be needed to discharge any residual charge remaining on the web once the receiver member has been removed.

As shown, the endless web 34 is entrained about, and runs about electrically grounded support rollers 36 and 37 one of which is driven by the motor drive or other suitable drive. The support rollers are located such that the web exhibits a wrap angle about a portion of the intermediate transfer member drum 20. The total wrap of the insulating endless web 34 (IEW) may extend from 1 mm to about 20 mm around the ITM 20. The total wrap of the IEW around the ITM is larger than the nip length between the transfer backing roller 33 and the ITM 20 and is at least about 1 mm at the entrance side to the nip to reduce ionization between the receiver sheet and the ITM in the pre-nip region. The nip length is the length of the contact region between the transfer backing roller 33 and the back surface 34B of the IEW taken in the direction of movement of the receiver sheet S. The receiver member S attaches to the IEW 34 at roller 37, with the aid of a charging roller or alternatively a corona charger 39*a* which charges one surface of the receiver member S so that it is electrostatically held with its other surface in contact with the web. The grounded roller 37 supplies charge to the backside of the IEW 34. The nip 30 defines the area of the substantial portion of the transfer of marking particle images from the intermediate transfer member 20 to the receiver member S (e.g., paper, transparency, etc.) which is transported at the appropriate time, under the control of the logic and control unit (LCU) between the web surface 34A and the intermediate transfer member. The nip 30 is the space between the transfer backing roller 33 and the ITM 20. The transfer backing roller 33 is positioned behind the endless web 34 in engagement with surface 34B thereof and is spring biased by a spring of any suitable form to apply an applied force of about 0.3 lbs./in to about 6 lbs./in wherein the force is expressed in per unit of linear length of the roller 33 (axial direction) to the web 34. The force establishes a narrow nip length where a substantial part of the transfer of the toner image to the receiver member or sheet occurs as the web surface 34A is pressed against the receiver sheet and the receiver sheet is pressed against the ITM 20. A backing roller may be provided to press roller 33 to limit distortion of this roller as described in U.S. Application Serial No. (Attorney docket No. 77,749) concurrently filed herewith in the name of Tombs et al.

The transfer backing roller 33 has an aluminum or other conductive metal core upon which is formed an outer blanket layer that has a high Young's Modulus of preferably greater than about 2 MPa; however, blankets of lesser hardness may also be suited. The transfer backing roller 33 is of a relatively small diameter when compared to the intermediate transfer member drum 20.

In the embodiment of the reproduction apparatus 10 shown in FIG. 1, according to this invention, a marking particle image is transferred to the receiver member S in nip 30, between the endless web 34 and the intermediate transfer member drum 20. Transfer backing roller 33 is electrically biased by potential source 29 providing preferably a constant transfer current of about 5 $\mu$amps to about 100 $\mu$amps to efficiently electrostatically urge transfer of the marking particle image from the intermediate transfer member drum 20 to the receiver member S as the receiver member moves through the nip while supported upon surface 34A of the web 34. The receiver member S is detacked from the web 34 by detack corona charger 39 which emits charge to discharge the receiver member, for example, by applying charge that will neutralize the charge on one surface of the receiver member S, and as noted above, is advanced to the fuser rollers 56 for fixing of the one or more colored toner images to the receiver member. As noted above plural colors may be serially transferred in registration to the receiver member or sheet where plural photoconductive drum ITM modules are provided so that a receiver member receives a different color image from each module as the belt transports the sheet from module to module. Cleaner member(s) (not shown) may be provided for cleaning both sides of the IEW.

It is preferred that substantial pressure in the nip at least about 5 psi (lbs/in$^2$) from the transfer backing roller 33 be provided to improve the quality of the transferred image in the case where an ITM has a compliant layer. The pressure in the nip aids transfer by reducing the size of microscopic air gaps in the nip caused by paper roughness, particulate contamination and image structure. Furthermore, the transfer step is made more robust by making the web wrap of the transport web 34 on the ITM 20 larger than the nip length between the transfer backing roller 33 and the ITM. The web wrap is not made too large to minimize unwanted movement between the print media and the transport web, which adversely affects image registration.

To summarize, the conditions for high quality and robust image transfer are (1) small web wraps; (2) web wraps larger than transfer backing roller/ITM nip lengths and (3) adequate pressure in the nip. The transfer configuration shown in FIG. 1 is designed to meet these requirements. To reduce the web wrap, the transfer backing roller 33 has a small diameter (10 mm as one example). The transfer backing roller comprises a solid metal core (6 mm diameter) and a resistive outer blanket layer (2 mm thick). The diameter of the ITM 20 in the example of FIG. 1 is about 180 mm.

In the embodiment of FIG. 1, the ITM 20 and transfer backing roller (TBR) 33 are biased to a polarity that is opposite of the polarity of the toner, e.g., if the toner polarity is negative then the ITM 20 and the TBR 33 would be biased positive. The magnitude of the voltage bias on the TBR 33 is set higher than that of the voltage bias on the ITM and the resulting currents act to move ions in the ITM polymer blanket layer 22 in opposite directions, i.e. from the periphery to the core and from the core to the periphery. An optimum biasing strategy for the configuration of FIG. 1 is one in which the magnitude of the current $I_1$ flowing between the ITM 20 and TBR 33 is considerably larger than the magnitude of the current $I_2$, flowing between the primary image forming member 12 and the ITM: $|I_1|>|I_2|$. The differences between the two currents $I_1$ and $I_2$, considering that one is negative relative to the other because of a different direction of movement through the polymer blanket, determines to a large extent, the useful life of the ITM. This is because, as noted above, a net current can affect the resistivity of the semiconductive polymer blanket layer. In accordance with the invention, the total current flowing in the polymer blanket layer 22 of the ITM is reduced. This is accomplished by supplying a third current $I_3$ so that the total current through the polymer blanket $I_t=I_1-I_2-I_3$ is closer to zero: $I_3\approx(I_1-I_2)$. The third current is supplied by an ion recharging device such as corona charger 50 in FIG. 1 which outputs in this example negative corona ions to establish the electrical current flow $I_3$ while $I_1$ and $I_2$ are operational. Other types of charging devices such as blade(s), brush(es), roller(s) may also be used as ion recharging device(s).

Other devices to recharge the polymer blanket layer 22 of the ITM such as a biased blade, brush or roller are also envisioned. The recharging component could also serve alternate purposes. One particularly useful second purpose would be as a pre-clean charger for the ITM to condition untransferred toner or to reduce the electrostatic adhesion attraction of the toner or marking particles to the ITM to facilitate removal by the cleaning device 17.

A current sensor (CS) is preferably associated with each power supply 28, 29 and 51 (the power supply for charger 50) and the sensed currents are provided to the LCU for adjusting current $I_3$ from charger 50 so that the total current $I_t$ is about zero. As used herein, wherein the charging of the ion recharging device(s) are run simultaneously with the charging by the transfer backing roller the term "about zero" implies that $|I_t|\leqq 0.15|I_1-I_2|$. It is preferred, however, that $|I_t|\leqq 0.01|I_1-I_2|$.

Figure 2:
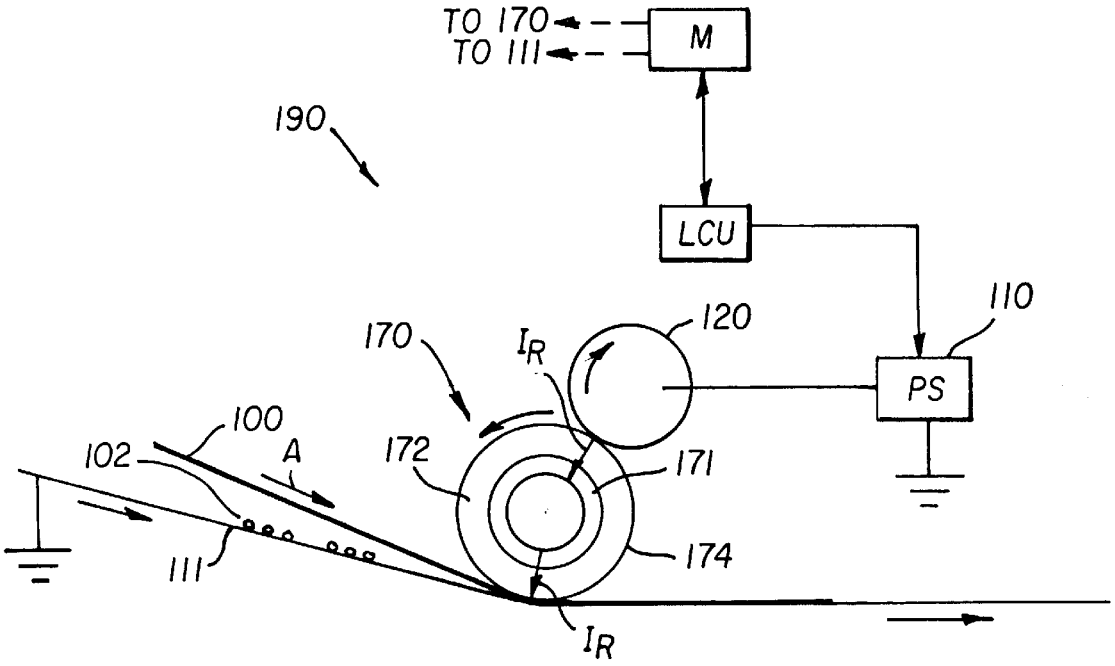
FIG. 2 is a side elevational view in schematic form of a portion of an electrostatographic reproduction apparatus forming a second embodiment of the invention and illustrating an example wherein there is direct transfer.

A second embodiment of the invention is illustrated in FIG. 2. This figure only shows the transfer subsystem 190 of an electrophotographic machine. A transfer roller 170 comprises an electrically conductive metal core or shaft 171 and a semiconductive polymer blanket layer 172. The blanket layer includes ionic conducting materials or anti-static particles or electrically conducting dopants to provide a volume resistivity in the range of about $10^7$ to about $10^{11}$ ohm-cm. The thickness of the blanket is between about 1 and about 20 mm. The toner image bearing member 111 is a photoconductor, with a ground stripe or layer, and is in the form of a web (a drum also may be used). The toner image bearing web is advanced by a suitable drive provided by motor M in the direction of the arrow A. The toner image bearing web 111 carries a receiver sheet 100 such as paper through the transfer nip formed by the wrap of the toner image bearing web around the transfer roller 170. The transfer roller 170 is rotating as shown and may also be driven. Examples of a transfer roller having semiconductive layers are described in U.S. Pat. No. 5,212,032 and U.S. application Ser. No. 08/845,300, filed in the name of Vreeland et al.

In this embodiment, the voltage output by power supply 110 is adjusted to provide a constant current used for image transfer as the receiver sheet 100 first enters the nip between the image-bearing member 111 and the transfer roller 170. If the toner image is formed of negative particles, the power supply 110 provides a positive voltage.

The second embodiment of the invention features use of only a single power supply to provide both the transfer current and the ion replenishment current.

The power supply 110 is provided as the source of both the transfer current and the ion replenishment current $I_R$ which must be equal. The power supply 110 supplies a constant current to the surface 174 of the transfer roller 170 through a metal roller 120 which engages surface 174 of the transfer roller and rotates with the transfer roller. The metal core 171 of the transfer roller is conducting and electrically floating, i.e., not connected to ground or a power supply. A voltage bias of the polarity suitable for transfer, e.g., positive to transfer the negative toner particles on the photoconductive imaging member 111, is provided by power supply 110 which is electrically connected to the metal roller 120. The voltage bias is adjusted to provide an optimum transfer current. In lieu of a metal roller, a brush or blade or corona charger may be substituted. The replenishment current $I_R$ flows from the metal roller 120 through the roller's semiconductive blanket layer 172 to the core 171 and then out through the roller blanket layer at the transfer nip, thereby also supplying the needed transfer current. The grounded electrode in the imaging member 111 supplies a ground path for the current. In this configuration of an electrically floating transfer roller, the current flowing from the blanket to the core always equals the current flowing from the core out through the blanket. This current is set to provide the optimum transfer bias.

Figure 3:
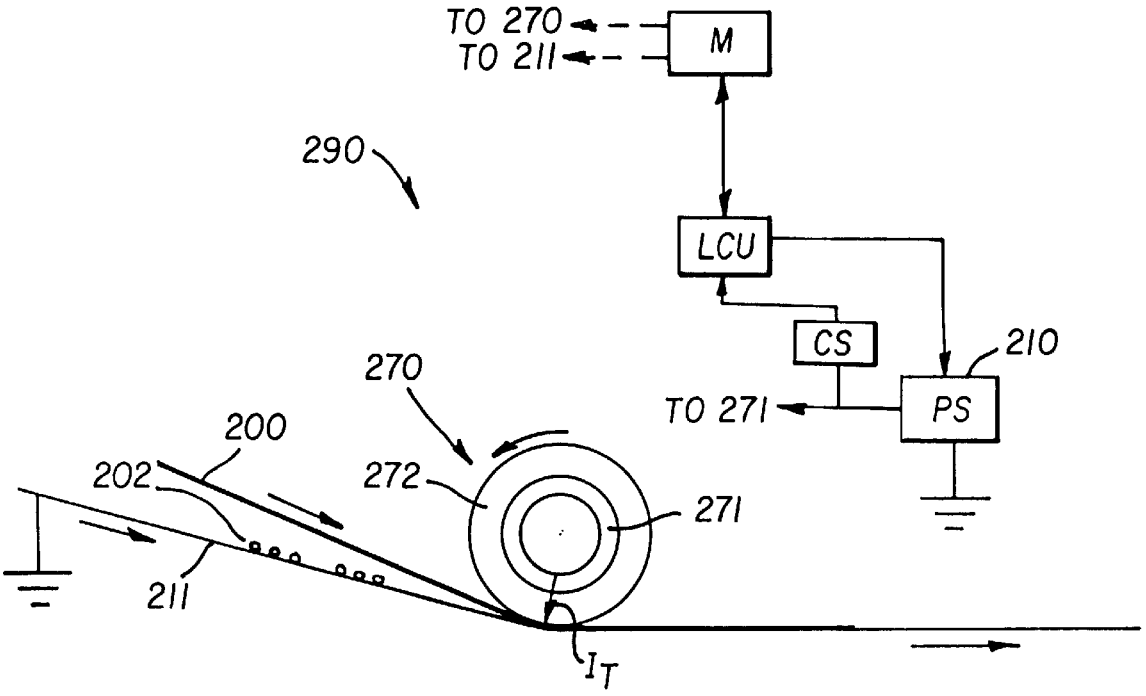
FIG. 3 is a side elevational view in schematic form of a portion of another electrostatographic reproduction apparatus forming a third embodiment of the invention and also illustrating an example of direct transfer.

A third embodiment of the invention is illustrated in FIG. 3 which also shows a transfer subsystem 290 of an electrophotographic machine. The structure of the transfer roller 270 and photoconductive member 211 are similar to that described for the embodiment of FIG. 2. Thus, the photoconductive member includes a toner image 202 which is transferred to a receiver sheet 200 in a nip formed by the photoconductive member and the transfer roller. The transfer roller includes an electrically conductive metal core 271 and a compliant semiconductive blanket layer 272 located about the conductive core. A power supply 210 is connected to the conductive core and provides transfer current $I_T$ while a receiver sheet 200 is in the nip. The transfer current is sensed by a current sensor CS which may be part of the power supply and communicated to a logic and control unit (LCU) which provides control of the transfer subsystem and may include controls for controlling motor drive (M) to the transfer roller 270 and the photoconductive member 211. The LCU stores the current level sensed and the time; i.e. duration, the current is provided to the transfer roller. During cycle up and/or cycle down of the machine and/or during rest and/or during an interframe, the LCU provides a command to the power supply 210 to reverse polarity of the voltage provided to the transfer roller 270 during transfer so that in certain periods of non-use; i.e. non-transfer, a replenishing current $I_R$ is provided through the polymer blanket that results in a net amount of charge (current multiplied by time active) that is reduced to about zero. Thus, for example, if during a production run when toner images are being transferred to receiver sheets, the transfer current, $I_T$, is run for a time $T_1$, the LCU may have the power supply 210 provide during cycle down the replenishing current $I_R$ for a time $T_2$ so that the product of $I_T \times T_1 \approx I_R \times T_2$. Thus, according to the invention, the product $I_R \times T_2$ is between 85% to 115% of $I_T \times T_1$ and preferably between about 99% and 101% of $I_T \times T_1$. Where the time that is available for providing the replenishment current is less than that used for transfer the replenishment current is adjusted accordingly by signals from the LCU to the power supply 210.

Thus, in the third embodiment of the invention, the power supply of the transfer subsystem is used during times when transfer is not occurring to recharge the polymer blanket. Examples of times when this can be accomplished is during the warm up cycle of the machine, whenever the machine is idle (between printing jobs), or anytime in the printing cycle when transfer is not occurring, such as in an interframe. The recharge cycle entails switching the polarity of one or more transfer power supplies to supply current through the polymer blanket. The magnitude of the current may be much higher in the recharge cycle than in the transfer cycle to compensate for the difference in time spent in the transfer cycle compared to the recharge cycle.

Figure 4:
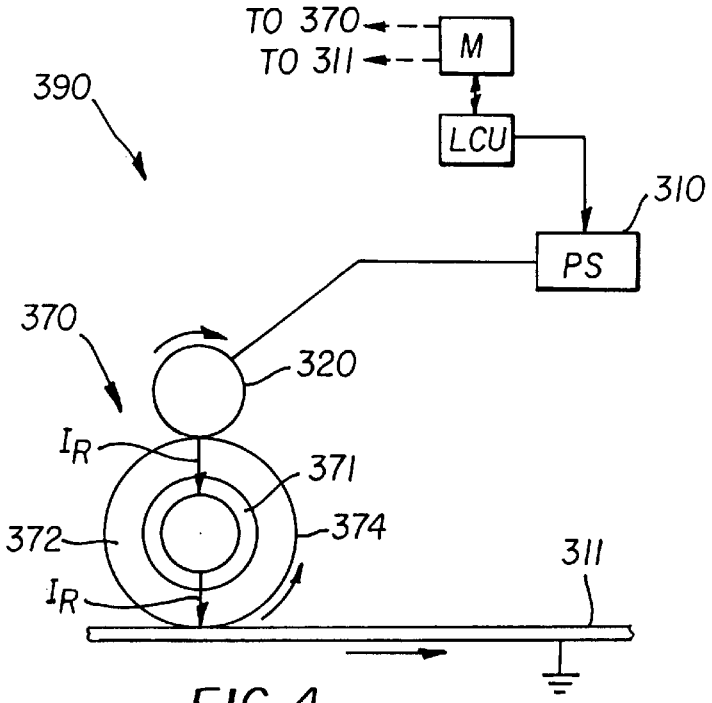
FIG. 4 is a side elevational view in schematic form of a portion of an electrostatographic reproduction apparatus forming a fourth embodiment of the invention and illustrating a roller charger in accordance with the invention.

A fourth embodiment of the invention is illustrated in FIG. 4 wherein there is shown a charging subsystem 390 of an electrophotographic apparatus for example a primary charger. In subsystem 390, a roller charger 370 is provided that is of similar structure to that of the transfer roller 170 of FIG. 2; i.e., an electrically conductive core 371 supports a semiconductive blanket layer 372. The blanket layer is of a material having characteristics described for the blanket layer 172. The electrically conductive core 371 may be metal and electrically floats. In lieu of a metal core a conductive layer may be provided on an insulating core. A moving photoconductive member 311 is in contact with the outer surface 374 of the roller charger. The photoconductive member 311 includes a grounded conducting stripe or layer. A conductive metal roller 320 is electrically connected to a power supply 310 and engages and rotates with the outer surface 374 of the roller charger. When electrostatic charging of the photoconductive member is to be made, the LCU activates the power supply 310 to provide a predetermined current to the roller 320. This current $I_R$ then passes through the blanket layer 372 to the conductive core 371 and from the conductive core through the blanket layer to deposit an electrostatic charge on the photoconductive member 311. In this embodiment as in the embodiment of FIG. 2, the same power supply provides the replenishment current and the charging current simultaneously. A motor drive provides rotation to the rollers 370 and 320 and movement of the photoconductive member 311 which may be a web or a roller. The member 311 may also be an insulating support used in electrography.

Thus according to the invention, replenishment currents to a semiconductive layer are provided which are controlled so that increased useful life can obtain to a charging member having such a semiconductive layer.

The invention has been described in detail with particular reference to certain preferred embodiments thereof, but it will be understood that variations and modifications can be effected within the spirit and scope of the invention.

What is claimed is:

1. An apparatus for applying a charge to a member to be charged, the apparatus comprising:

a moving charge applying member, the charge applying member including an electrically conductive member and a semiconductive layer supported upon the conductive member, the semiconductive layer formed of a material having a volume resistivity of between about $1\times10^7$ ohm-cm and about $1\times10^{11}$ ohm-cm; and electrical bias means for electrically biasing the charge applying member, the electrical bias means applying an electrical bias to the charge applying member so that an electrical current flows from a peripheral surface of the charge applying member through the semiconductive layer to the conductive member and from the conductive member through the semiconductive layer to the member to be charged so that a net charge flowing through the semiconductive layer is about zero.

2. The apparatus of claim 1 wherein the conductive member of the charge applying member electrically floats relative to ground potential.

3. The apparatus of claim 2 wherein the electrical bias means includes a constant current source.

4. The apparatus of claim 2 in combination with the member to be charged and wherein the member to be charged engages the moving charge applying member and wherein the member to be charged is a photoconductor.

5. The apparatus of claim 2 wherein the electrical bias means includes a member that is electrically biased and in contact with the peripheral surface of the charge applying member.

6. The apparatus of claim 1 wherein the charge applying member is an intermediate transfer member (ITM), the ITM is electrically coupled to a primary toner image bearing member and the electrical bias means includes an electrically biased transfer backing roller at a first electrical bias, a bias supply connected to the conductive member at a second electrical bias and an electrical biasing device at a third electrical bias that is electrically coupled to an outer surface of the ITM for establishing a net charge flow of about zero through the semiconductive layer.

7. The apparatus of claim 6 and including a transport web passing within a nip between the transfer backing roller and the ITM for transporting a receiver sheet in the nip.

8. The apparatus of claim 7 wherein the web includes a layer having a volume electrical resistivity greater than $1\times10^{12}$ ohm-cm.

9. The apparatus of claim 6 wherein a cleaning device is located adjacent the outer surface of the ITM for cleaning the ITM and the electrical biasing device is a preclean charger for conditioning untransferred toner on the periphery for removal by the cleaning device.

10. The apparatus of claim 1 wherein the member to be charged receives a uniform primary charge.

11. A method for applying a charge, the method comprising:

providing a charge applying member in engagement with a member to be charged, the charge applying member including an electrically conductive member and a semiconductive layer supported upon the conductive member, the semiconductive layer being formed of a material having a volume electrical resistivity of between about $1\times10^{7}$ ohm-cm and about $1\times10^{11}$ ohm-cm; and electrically biasing the charge applying member so that an electrical current flows from a peripheral surface of the charge applying member through the semiconductive layer to the conductive member and from the conductive member through the semiconductive layer to the member to be charged so that a net charge flowing through the semiconductive layer is about zero.

12. The method of claim 11 wherein the conductive member of the charge applying member electrically floats relative to ground potential.

13. The method of claim 12 wherein the electrical biasing provides a constant current.

14. The method of claim 12 wherein the charge applying member provides a uniform charge upon the member to be charged.

15. The method of claim 12 wherein the electrical biasing is by a member that is electrically biased and in contact with the peripheral surface of the charge applying member.

16. The method of claim 15 wherein the charge applying member is a transfer roller and a toner image on a toner image bearing member (TIBM) is transferred to a receiver sheet that is between the TIBM and the transfer roller.

17. The method claim 11 wherein the charge applying member is an intermediate transfer member (ITM) and the member to be charged is a toner image bearing member (TIBM), the ITM engages the TIBM to transfer a toner image on the TIBM to the ITM in a first nip and the ITM transfers the toner image to a receiver sheet in a second nip, and the electrical biasing includes a bias supply connected to the conductive member and a source of charge located at the peripheral surface of the charge applying member at a location remote from the first nip and the second nip.

18. The method of claim 17 and including passing a transport web within the second nip to transport a receiver sheet in the second nip.

19. The method of claim 17 and including operating a cleaning device adjacent the peripheral surface of the charge applying member to clean the ITM, and the source of charge located at the peripheral surface provides a preclean charge for conditioning untransferred toner on the peripheral surface for removal by the cleaning device.

20. The method of claim 11 and including monitoring of time that current is provided during a toner image transfer operation, and providing a reverse current flow to the conductive member during a non-transfer operation to reduce the net charge flowing through the semiconductive layer.

21. The method of claim 11 wherein amount of charge in a first direction through the semiconductive layer is within 15% of amount of charge in a second direction through the semiconductive layer.

22. The method of claim 11 wherein amount of charge in a first direction through the semiconductive layer is within 1% of amount of charge in a second direction through the semiconductive layer.

* * * * *